US010383456B1

(12) United States Patent
Gyasi

(10) Patent No.: US 10,383,456 B1
(45) Date of Patent: Aug. 20, 2019

(54) BABY WALKER TRAINING DEVICE

(71) Applicant: Andrews K. Gyasi, Alexandria, VA (US)

(72) Inventor: Andrews K. Gyasi, Alexandria, VA (US)

( * ) Notice: Subject to any disclaimer, the term of this patent is extended or adjusted under 35 U.S.C. 154(b) by 0 days.

(21) Appl. No.: 16/178,568

(22) Filed: Nov. 1, 2018

(51) Int. Cl.
*A47D 13/04* (2006.01)
*A61H 3/04* (2006.01)
*A47D 13/08* (2006.01)

(52) U.S. Cl.
CPC ..... *A47D 13/04* (2013.01); *A61H 3/04* (2013.01); *A47D 13/08* (2013.01)

(58) Field of Classification Search
CPC ..... A47D 13/025; A47D 13/04; A47D 11/00
See application file for complete search history.

(56) References Cited

U.S. PATENT DOCUMENTS 9,289,077 B1 * 3/2016 Gyasi ..... A47D 13/04

* cited by examiner

*Primary Examiner* — James A Shriver, II
*Assistant Examiner* — James J Triggs
(74) *Attorney, Agent, or Firm* — Bruce A. Lev

(57) ABSTRACT

A walker to assist an infant in walking system including an infant walker assembly having, a triangular-shaped base unit including a horizontal support portion and, a perpendicular support portion; a first vertical support bar; an angled support portion; a T-shaped handle; and at least three wheels coupled to the triangular-shaped base unit. The infant walker assembly is made of non-toxic coated metal material for safety of the infant. The horizontal support portion and the perpendicular support portion together form the triangular-shaped base unit. The three wheels are positionally coupled to the T-shaped base-unit making said infant walker assembly movable so that said infant-user can push said infant walker assembly when learning how to walk.

15 Claims, 4 Drawing Sheets

BABY WALKER TRAINING DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of baby walkers and more specifically relates to a baby walker training device structured and arranged for use by infant children to provide a practical assist for infants, particularly those born with varying disabilities, in the developmental transition from crawling to walking.

2. Description of the Related Art

The first few years of a child's life are marked by many milestones, both physical and developmental. A first tooth, the first time a child rolls over unassisted and the first time a baby takes solid food are but a few of the precious moments which mark the steady development of an infant child. For many parents, the first time their child crawls is of special significance, as this new mobility is the first "step" many little ones take toward independence. Most babies learn to crawl between 6 and 10 months, after they have developed the strength to sit upright on their own.

A child's first toddling steps can begin immediately after learning to crawl, or can take several months to master. As most parents know, a child's first steps are often met with bumps and bruises as the inexperienced walker can easily loose his or her balance while trying to steady themselves on their feet or when trying to take quick steps. This is especially true for children who, as a result of premature birth or various medical disabilities, have slowed or compromised development.

Unfortunately, for these infants and many able-bodied children as well, the transition to walking can be an extremely challenging and arduous process that in worse case scenarios can render the child frustrated and sore. Since teaching a child to walk can be so difficult, many parents utilize infant walkers as a means of safely providing an infant mobility. Standard walkers are collapsible, saucer shaped units featuring a basket or sack style seat. Notably, these walkers rest atop four, wheeled casters which enable the child to safely propel the device in any direction, via their feet. Not surprisingly however, these walkers do little good if children lack the motor skills and strength to operate these devices.

Various attempts have been made to solve problems found in baby walker devices art. Among these are found in: U.S. Pat. No. 4,946,158 to Hamad Olayan et al; U.S. Pat. No. 202,724 to John H. Headler; and U.S. Pat. No. 8,079,379 to Antonio Vilar Peron. This prior art is representative of upright baby walkers. None of the above inventions and patents, taken either singly or in combination, is seen to describe the invention as claimed.

Ideally, a baby walker training device should be user-friendly and safe in-use and, yet would operate reliably and be manufactured at a modest expense. Thus, a need exists for a baby walker training device structured and arranged for use by infant children to provide a practical assist for infants, particularly those born with varying disabilities, in the developmental transition from crawling to walking and to avoid the above-mentioned problems.

BRIEF SUMMARY OF THE INVENTION

In view of the foregoing disadvantages inherent in the known of baby walker device art, the present invention provides a novel walker to assist an infant in walking system (Entitled baby walker training device). The general purpose of the present invention, which will be described subsequently in greater detail is to provide a walker to assist an infant in walking system structured and arranged for use by infant children to provide a practical assist for infants, particularly those born with varying disabilities, in the developmental transition from crawling to walking.

A walker to assist an infant in walking system comprising: an infant walker assembly having a triangular-shaped base unit including a horizontal support portion and a perpendicular support portion; a first vertical support bar; an angled support portion; a T-shaped handle; and at least three wheels coupled to the triangular-shaped base unit such that one of the at least three wheels is connected to a distal end of the perpendicular support portion, and two of the at least three wheels are connected to respective opposite ends of the horizontal support portion. The horizontal support portion and the perpendicular support portion together form the triangular-shaped base unit. Wherein the first vertical support bar is perpendicularly coupled to said triangular-shaped unit.

Wherein the angled support portion is angularly-coupled between the T-shaped base at a distal end of the perpendicular support portion and a top of the first vertical support bar thereby creating a triangular-gusseted configuration.

Wherein the T-shaped handle is adjustably mounted onto an apex of the triangular-gusseted configuration where the first vertically mounted support bar and the angled support portion are coupled together and is adapted to be adjusted in height to accommodate infants of different heights. Wherein the T-shaped handle provides a hand-gripping region for an infant-user to hold on to support a body weight of the infant-user.

Wherein each of the three wheels is positionally coupled to the T-shaped base-unit making the infant walker assembly movable so that the infant-user can push the infant walker assembly when learning how to walk. Wherein each of the two wheels that are connected to the respective opposite ends of the horizontal support portion includes a speed adjuster assembly thereon adapted to control the speed of rotation of the wheel to thereby control the rate of movement of the walker.

The present invention holds significant improvements and serves as a Walker to Assist an Infant in Walking System. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Baby Walker Training Device constructed and operative according to the teachings of the present invention.

The various embodiments of the present invention will hereinafter be described in conjunction with the appended drawings, wherein like designations denote like elements.

DETAILED DESCRIPTION

Figure 1:
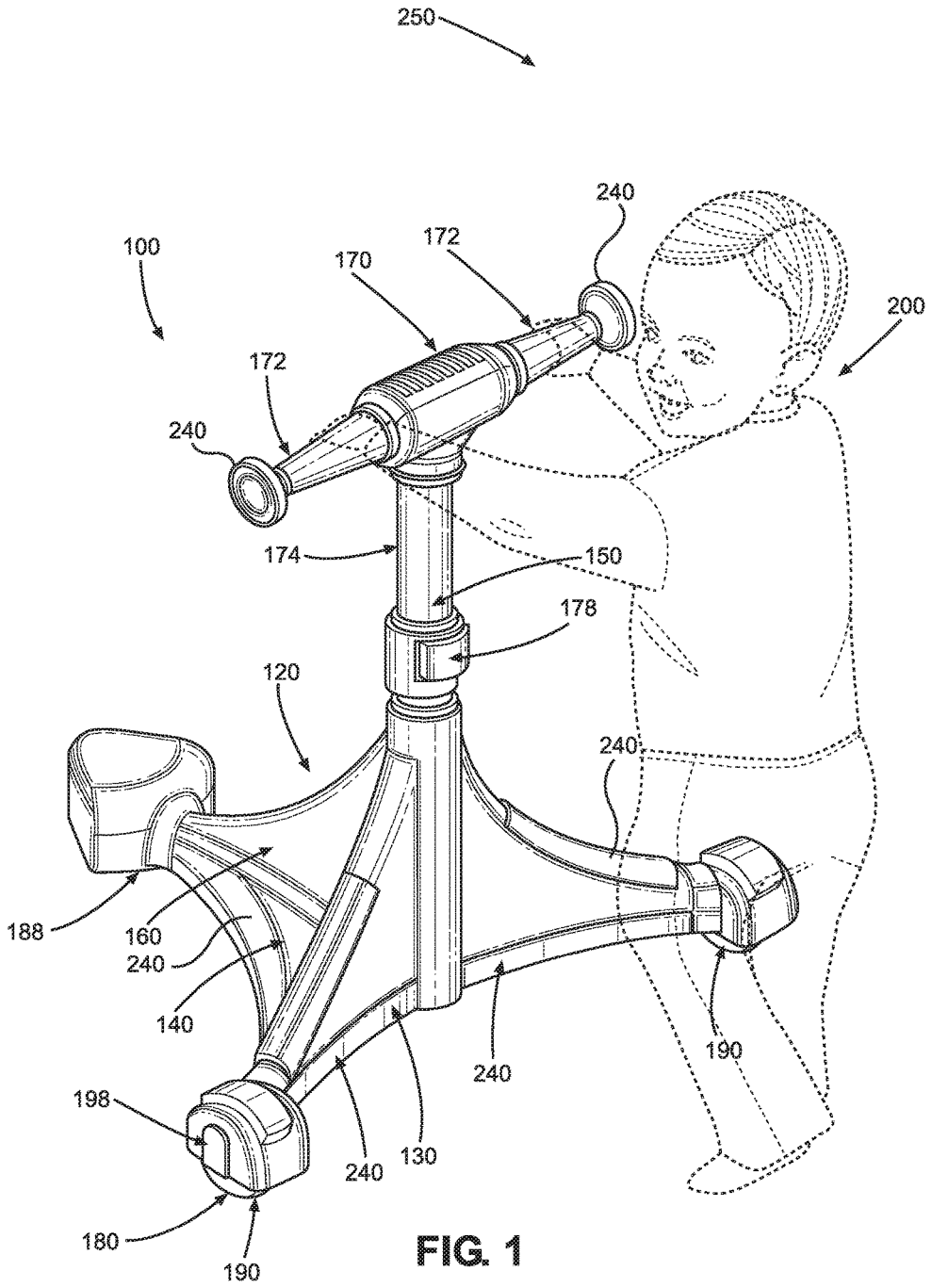
FIG. 1 is a perspective view illustrating the preferred embodiment of the infant walker assembly of the present invention.
Figure 2:
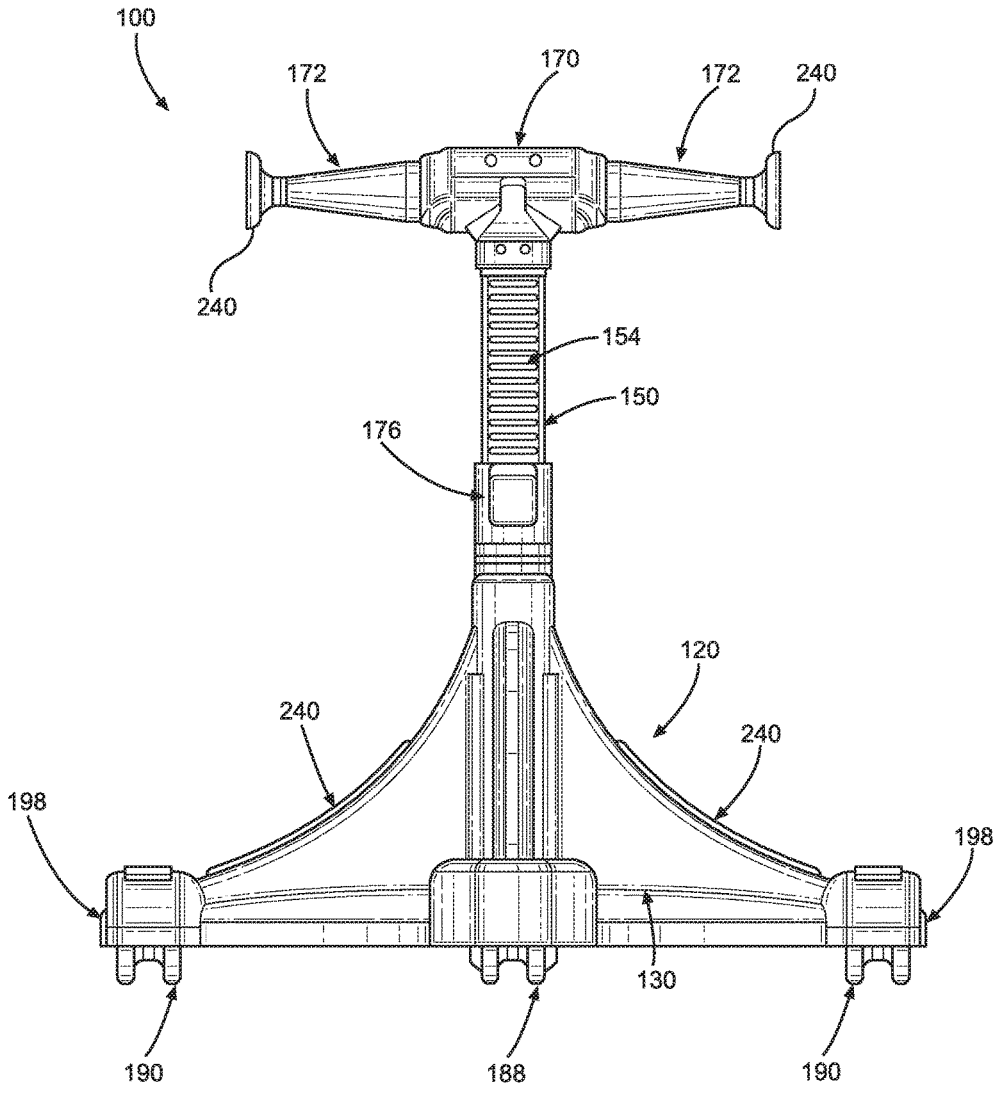
FIG. 2 is a front view illustrating the preferred embodiment of the infant walker assembly according to the embodiment of the present invention of FIG. 1.
Figure 3:
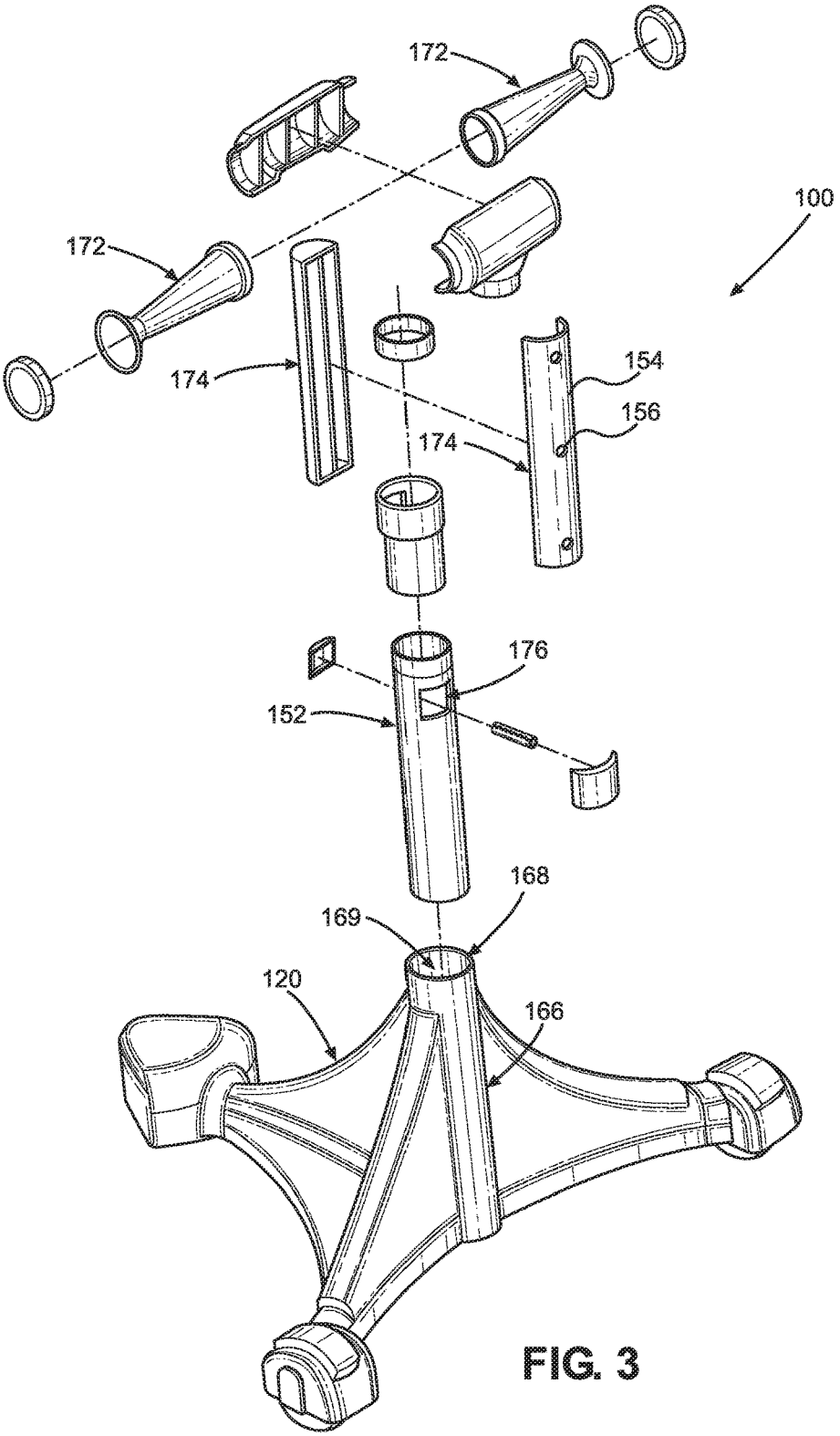
FIG. 3 illustrates an exploded view of the preferred embodiment of the infant walker assembly according to the embodiment of the present invention of FIG. 1.

As discussed above, embodiments of the present invention relate to a baby walker device and more particularly to a walker to assist an infant in walking system (Entitled Baby Walker Training Device) configured expressly for use by infant children to provide a practical assist for infants, particularly those born with varying disabilities, in the developmental transition from crawling to walking through use of the present invention.

Generally speaking, the Walker to Assist an Infant in Walking System comprises a specially designed assistive walker configured expressly for use by children, particularly those with developmental disabilities.

Scaled for use by infant and toddler children, the Walker to Assist an Infant in Walking System could be manufactured primarily of coated metal or plastic material and would feature rubber and plastic components. This walker may be comprised of a triangular-shaped base unit featuring a horizontal support portion in the center of which a second support is perpendicularly attached. Designed to rest on the ground, this base support preferably features three, heavy duty wheeled castors which would move in all directions for balance, facilitating free and stable movement of the device. These wheels are appropriately positioned on the end of each of the base unit's support arms.

Vertically and centrally attached to the horizontal support arm may be a vertical support portion, reinforced by way of an angled support arm that is connected to the distal end of the base unit's perpendicular support, thus creating a triangular configuration. Mounted to the top of the juncture where the vertical and angled arm meet may be a T-shaped handle coated in nonskid, grooved rubber that facilitates a firm and comfortable hold during use. Importantly, this handle is wider in diameter at the center of the unit and taper inwards in a conical fashion towards its distal ends. In this manner, the child can grip the portion of the handle that most comfortably fits into their hands. The Walker to Assist an Infant in Walking System may be offered in a host of vibrant colors that appeal to children. Because the safety of the infant is of the utmost importance, the Walker to Assist an Infant in Walking System would be manufactured to meet all guidelines for children's furniture as set by the Juvenile Products Manufactures Association (JPMA).

The Walker to Assist an Infant in Walking System provides parents and caregivers a sturdy and reliable infant walker which greatly assists a child in the transition from crawling to standing upright and walking. Offering an innovative design developed expressly with the needs of disabled children in mind, the Walker to Assist an Infant in Walking System provides a practical and easily employed alternative to traditional saucer-style walkers that are navigated only by the child's feet.

With this unique walker's wheels designed to move in tandem across a variety of surfaces and the vertical support facilitating sure and stable balance, the Walker to Assist an Infant in Walking System may significantly reduce the time it takes for a child to transition from crawling to walking. This advantage may prove appealing to the parents of both disabled and able-bodied infants and toddlers. Offering reliable support to the child as they walked, use the Walker to Assist an Infant in Walking System could effectively prevent the child from toppling over and accidentally slipping and falling when taking their first, tentative steps.

Allowing the active child the freedom to comfortably stand in the upright position, as well as to easily turn in any direction, this innovative walker encourages the child to explore their environment, as well as to freely move all of their limbs.

Referring to the drawings by numerals of reference there is shown in FIGS. 1-5 views illustrating walker to assist an infant in walking system 100 according to an embodiment of the present invention.

Walker to assist infant in walking system 100 comprising: infant walker assembly 110 having a triangular-shaped base unit 120 including horizontal support portion 130 and perpendicular support portion 140; vertical support bar 150; angled support portion 160; T-shaped handle 170; and at least three wheels 180 coupled to triangular-shaped base unit 120 such that one 188 of at least three wheels 180 is connected to distal end 144 of perpendicular support portion 140, and two 190 of at least three wheels 180 are connected to respective opposite ends of horizontal support portion 130. Wherein infant walker assembly 110 comprises non-toxic coated metal material for safety of infant 250. Wherein the non-toxic coated plastic material of infant walker assembly 110 comprises plastic. Upon reading this specification, it should be appreciated that, under appropriate circumstances, considering such issues as user preferences, design preference, structural requirements, marketing preferences, cost, available materials, technological advances, etc., other material arrangements such as, for example, non-toxic coated plastic material, etc., may be sufficient.

The vertical support bar 150 is perpendicularly coupled to triangular-shaped base unit 120 and adds balance and stability to the infant walker assembly and decreases the chance of the infant walker assembly tipping over. Furthermore, the vertically mounted support bar 150 is formed having first hollow interior portion 152 having movable connector member 176 thereon; wherein the apex 168 of triangular-gusseted configuration 166 is formed having second hollow interior portion 169 adapted to be in conjunction with the first hollow interior portion 152 of vertically mounted support bar 150. Furthermore, the T-shaped handle 170 includes vertical post member 174, which includes a series of first connector members 154 thereon, and is adapted to be movably located within the first hollow interior portion 152 of the vertically mounted support bar and releasably engage with movable connector member 176 of vertical post member 174, such that T-shaped handle 170 is vertically adjustably with respect to apex 168 to thereby accommodate infants of different heights. Furthermore, the series of first connector members 154 may be formed as a series of ridges or holes 156 through the first vertically mounted support bar 150; and second connector member 176 may include a biased pin member 178 adapted to removably engage any one of the series of ridges or holes 156.

The T-shaped handle 170 may provide hand-gripping region 172 for infant-user 250 to hold on to. The T-shaped handle 170 is able to be moved in relation to triangular-gusseted configuration 166. The T-shaped handle 170 may further comprise coated nonskid, grooved rubber that permits hands of infant 250 to facilitate a firm and comfortable grip. The T-shaped handle 170 may be wider in diameter at a center portion thereof and taper inwardly in a conical fashion towards terminal ends thereof, such that the tapering permits infant 250 to grip the T-shaped handle 170 at a region that most comfortably conforms to their hands.

Figure 4:
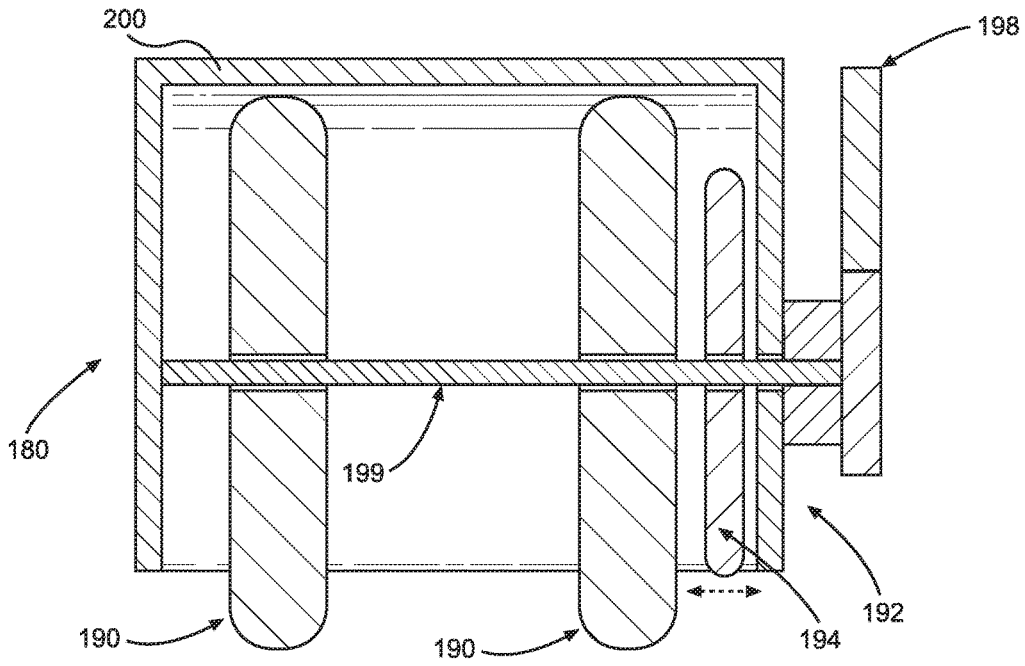
FIG. 4 is a cut-away side view of a wheel including a speed adjuster assembly according to the preferred embodiment of the present invention of FIG. 1.
Figure 5:
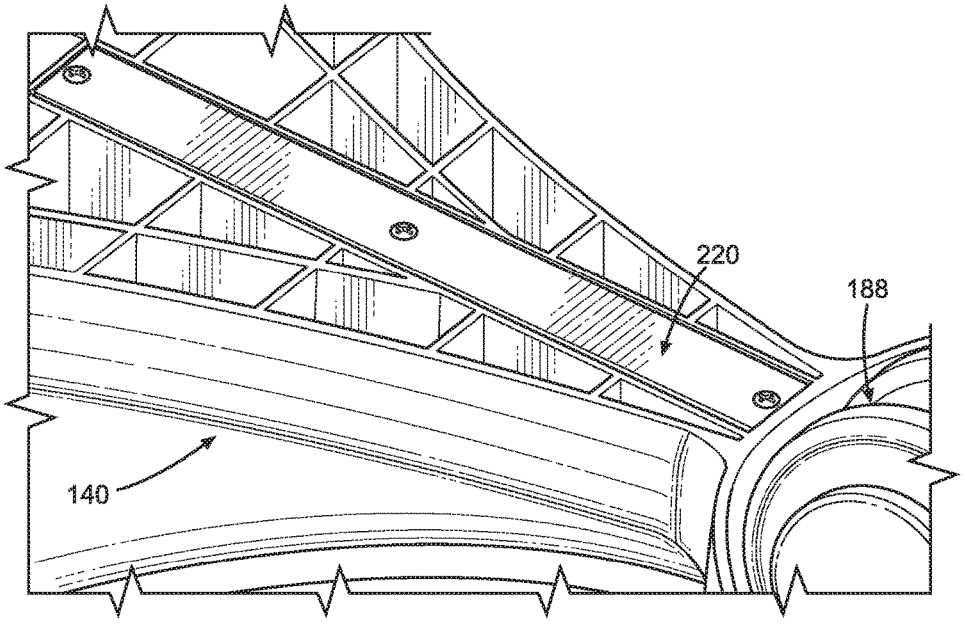
FIG. 5 illustrates a perspective bottom view including a weight member attached to an underside of the of the infant walker assembly according to the preferred embodiment of the present invention of FIG. 1.

In one preferred embodiment, each of the three wheels 180 are positionally and rotatably coupled to the triangular-shaped base-unit 120 making infant walker assembly 110 movable so that infant 250 can push the infant walker assembly 110 when learning how to walk. Each of the two wheels 190 that are connected to respective opposite ends of horizontal support portion 130 includes speed adjuster assembly 192, as shown in FIG. 4, thereon adapted to control the speed of rotation of wheels 180 to thereby control the rate of movement of walker 100. Each speed adjuster assembly 192 includes friction disc 194 attached to an axle 199 of each respective wheel 190 and frictionally engage with respective wheel 190 to thereby slow the rotational movement thereof; and adjustable connector member 198 is adapted to attach to an end portion of axle member 199 of the respective wheel 180 and adapted to adjustably engage and push friction disc 194 against wheel 190 to thereby adjustably slow rotational movement thereof.

In one embodiment, the three wheels 180 coupled to the triangular-shaped base unit 120 comprise heavy-duty castors comprising swivels to permit infant walker assembly 110 to move and rotate in various directions. The swivel castors allow infant 250 to move across a variety of surfaces.

In a preferred embodiment, each of the at least three wheels 180 coupled to the triangular-shaped base unit are formed as double-wheels 190 and include a safety cover 200 thereon. Furthermore, each of the two wheels that are connected to the respective opposite ends of the horizontal support portion are not pivotable and thereby cannot swivel, and the wheel 188 connected to distal end 144 of perpendicular support portion 140 is pivotable and thereby can swivel.

In a preferred embodiment, a weight member 220 can be releasably attached to an underside of the triangular-shaped base unit 120 in proximity to the distal end of the perpendicular support portion 140 to thereby increase the stability of said walker when in use.

In the preferred embodiment, the walker may further include protective foam 240 attached to outer portions of the T-shaped handle and the triangular-shaped base unit to protect infants from injury.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A walker to assist an infant in walking system comprising:

an infant walker assembly having, a triangular-shaped base unit including, a horizontal support portion and, a perpendicular support portion;

a first vertical support bar;

an angled support portion;

a T-shaped handle; and at least three wheels coupled to said triangular-shaped base unit, such that one of said at least three wheels is connected to a distal end of said perpendicular support portion, and two of said at least three wheels are connected to respective opposite ends of said horizontal support portion;

wherein said first vertical support bar is perpendicularly coupled to said triangular-shaped base unit;

wherein said angled support portion is angularly-coupled between said triangular-shaped base and said first vertical support bar thereby creating a triangular-gusseted configuration;

wherein said T-shaped handle is adjustably mounted onto an apex of said triangular-gusseted configuration where said first vertically mounted support bar and said angled support portion are coupled together, and is adapted to be adjusted in height to accommodate infants of different heights, wherein said T-shaped handle provides a hand-gripping region for an infant-user to hold on to support a body weight of said infant-user;

wherein each of said at least three wheels is positionally coupled to said triangular-shaped base unit making said infant walker assembly movable so that said infant-user pushes said infant walker assembly when learning how to walk; and wherein each of said three wheels that are connected to said respective opposite ends of said horizontal support portion includes a speed adjuster assembly thereon adapted to control the speed of rotation of said wheel to thereby control the rate of movement of said walker.

2. The walker to assist an infant in walking system of claim 1 wherein said horizontal support portion is coupled to said perpendicular support portion on said triangular-shaped base unit via at least one fastener.

3. The walker to assist an infant in walking system of claim 1 wherein said first vertical support bar and said angled support portion are coupled to said triangular-shaped base unit via at least one fastener.

4. The walker to assist an infant in walking system of claim 1 wherein said first vertically mounted support bar is formed having a hollow interior portion having a first connector member thereon; wherein said apex of said triangular-gusseted configuration is formed having a hollow interior portion adapted to be in conjunction with said hollow interior portion of said first vertically mounted support bar; and wherein said T-shaped handle includes a vertical post member adapted to be movably located within said hollow interior portions of said apex and said first vertically mounted support bar and includes a second connector member thereon adapted to releasably engage said first connector member of said first vertically mounted support bar, such that said T-shaped handle is vertically adjustably with respect to said apex and said first vertically mounted support bar to thereby accommodate infants of different heights.

5. The walker to assist an infant in walking system of claim 1 wherein said at least three wheels coupled to said triangular-shaped base unit comprise heavy-duty castors.

6. The walker to assist an infant in walking system of claim 5 wherein said heavy-duty castors comprise swivel castors to permit said infant walker assembly to move and rotate when in an in-use condition.

7. The walker to assist an infant in walking system of claim 1 wherein said T-shaped handle comprises coated nonskid, grooved rubber.

8. The walker to assist an infant in walking system of claim 1 wherein said T-shaped handle is wider in diameter at a center of said T-shaped handle and tapers inwardly in a conical fashion towards terminal ends of said T-shaped handle.

9. The walker to assist an infant in walking system of claim 8 wherein said tapering permits said infant to grip said T-shaped handle at a region that most comfortably conforms to said hands of said infant.

10. The walker to assist an infant in walking system of claim 4 wherein said first connector member includes a linear series of holes through said first vertically mounted support bar; and said second connector member includes a biased pin member adapted to removably engage any one of said linear series of holes.

11. The walker to assist an infant in walking system of claim 1 wherein each said speed adjuster assembly includes a friction disc adapted to attach to an axle member of a respective said wheel and frictionally engage with said respective said wheel to thereby slow rotational movement thereof; and an adjustable connector member adapted to attach to an end portion of said axle member of said respective said wheel and adapted to adjustably engage and pushes said friction disc against said wheel to thereby adjustably slow rotational movement thereof.

12. The walker to assist an infant in walking system of claim 1 wherein each of said at least three wheels coupled to said triangular-shaped base unit are formed as double-wheels and include a safety cover thereon.

13. The walker to assist an infant in walking system of claim 1 wherein said wheel that is connected to said distal end of said perpendicular support portion is pivotally connected thereto and is adapted to swivel; and wherein each of said two three wheels that are connected to said respective opposite ends of said horizontal support portion are not pivotable and thereby cannot swivel.

14. The walker to assist an infant in walking system of claim 1 further comprising a weight member releasably attached to an underside of said triangular-shaped base unit in proximity to said distal end of said perpendicular support portion to thereby increase the stability of said walker when in use.

15. The walker to assist an infant in walking system of claim 1 further comprising protective foam attached to outer portions of said T-shaped handle and said triangular-shaped base unit.

* * * * *